US008599082B2

(12) United States Patent
Mitchell et al.

(10) Patent No.: US 8,599,082 B2
(45) Date of Patent: Dec. 3, 2013

(54) BRACKET ASSEMBLY FOR A WIRELESS TELEMETRY COMPONENT

(75) Inventors: David J. Mitchell, Oviedo, FL (US); Anand A. Kulkarni, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 505 days.

(21) Appl. No.: 13/018,455

(22) Filed: Feb. 1, 2011

(65) Prior Publication Data

US 2012/0194396 A1 Aug. 2, 2012

(51) Int. Cl.
*H01Q 1/00* (2006.01)

(52) U.S. Cl.
USPC ..... 343/720; 343/872

(58) Field of Classification Search
USPC ..... 343/720, 872; 340/870.01; 374/141, 374/179
See application file for complete search history.

(56) References Cited

U.S. PATENT DOCUMENTS

| | | | | |
|---|---|---|---|---|
| 6,576,861 | B2 | 6/2003 | Sampath et al. | |
| 6,682,307 | B1 | 1/2004 | Tiemann | |
| 7,300,253 | B2 | 11/2007 | Beeck et al. | |
| 7,368,827 | B2 | 5/2008 | Kulkarni et al. | |
| 7,500,832 | B2 | 3/2009 | Zagar et al. | |
| 2009/0121896 | A1 | 5/2009 | Mitchell et al. | |
| 2012/0256761 | A1 * | 10/2012 | Mitchell et al. | 340/870.02 |
| 2012/0283963 | A1 * | 11/2012 | Mitchell et al. | 702/34 |
| 2013/0008179 | A1 * | 1/2013 | Mitchell et al. | 60/796 |

* cited by examiner

*Primary Examiner* — Hoanganh Le

(57) ABSTRACT

A bracket assembly is used to mount a wireless telemetry component proximate a rotating component of a combustion turbine engine (10), wherein the wireless telemetry component includes an RF transparent ceramic cover (128). The bracket assembly comprises a first mounting bracket (125) on a surface proximate the rotating component that includes a first (138) and second (139) bracket member spaced apart from one another. The first (138) and second (139) bracket members are disposed generally perpendicular to a direction of centrifugal forces generated by the rotating component. At least one of the first (138) or second bracket (139) members is inclined toward the other bracket member and disposed at an acute angle relative to the surface (141) proximate the rotating component.

17 Claims, 12 Drawing Sheets

BRACKET ASSEMBLY FOR A WIRELESS TELEMETRY COMPONENT

FIELD OF THE INVENTION

The present invention relates generally to monitoring operating environments and in particular to instrumented components and telemetry systems enabled for wirelessly transmitting electronic data indicative of individual component condition within an operating environment such as that of a combustion turbine engine.

BACKGROUND OF THE INVENTION

A wireless telemetry system for a turbine combustion is disclosed in U.S. application Ser. No. 11/936,936, which is incorporated herein by reference. As disclosed therein, a high temperature wireless telemetry system may be powered by induced RF energy generated by air gap transformers including a transformer primary induction coil assembly that is stationary and a secondary induction coil assembly that rotates. The telemetry system includes at least one sensor deposited on a component such as a turbine blade. A telemetry transmitter circuit is affixed to the turbine blade and a connecting material is deposited on the turbine blade for routing electronic data signals from the sensor to the telemetry transmitter circuit, the electronic data signals indicative of a condition of the turbine blade. An induction power system is provided for powering the telemetry transmitter circuit with a rotating data antenna affixed to the root of the turbine blade, such as the turbine blade; and a stationary data antenna affixed to a static seal segment adjacent to the turbine blade.

As shown in FIG. 1, the prior art telemetry transmitter assembly 300 is mounted to a side of a platform 301 supporting a turbine blade 302. The transmitter assembly 300 is in electrical communication with a sensor (not shown) on the blade 302 via a first electrical connection 304. The transmitter assembly 300 includes a cover member 303 bolted to a bracket member 305 with a transmitter circuit board disposed therebetween. The assembly 300 may be affixed to a transition area of the platform 301 in a recess 306 using an epoxy, adhesive, brazing, transient liquid phase bonding, diffusion bonding, welding, mechanical fixation, such as bolting, or any other joining method known to those in the art. A backfill material may be placed over them for protection from high temperatures or particulate debris.

A rotating data antenna assembly 308 is mounted to a face of the turbine root 301, and is in electrical communication with the transmitter assembly 300 via a second electrical 310. The antenna assembly 308 includes an induction coil and antenna secured within an RF transparent ceramic cover 311, which is mounted to the face of the blade root 309 using a bracket 313. The cover 311 includes flanges 312 secured in the bracket 313, and the flanges 312 are oriented on the root 309 parallel with, rather than perpendicular to, the centrifugal force direction (represented by the arrow labeled "C") of the rotating blade 302, so the ceramic cover 311 is loaded in compression and not in bending.

While the above-described rotating antenna assembly 308 works for certain turbine engine designs, it may not be compatible with turbine blade sections that incorporate seal plates. Seal plates are often mounted to a turbine rotor disc on which the rotor blades are fixed to seal cooling fluid paths. However, the above-described rotating antenna assembly may not be used with seal plates. There is insufficient space between the seal plate and face of the root blade, and if the antenna assembly is capable of being mounted to the blade root face, the seal plate would interfere with transmission of signals from the antenna.

DETAILED DESCRIPTION OF THE INVENTION

Figure 2:
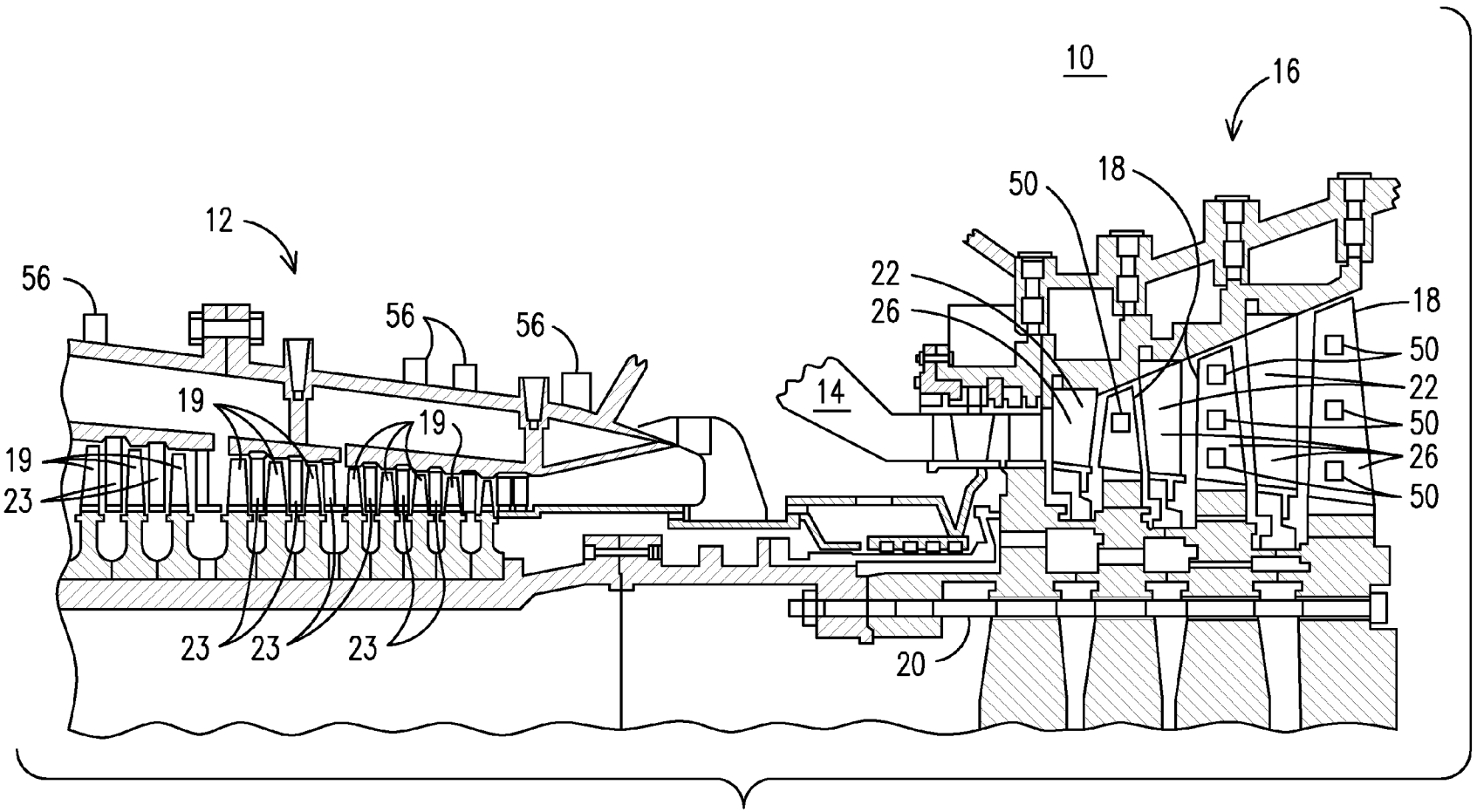
FIG. 2 is a cross sectional view of an exemplary combustion turbine.

FIG. 2 illustrates an exemplary combustion turbine 10 such as a gas turbine used for generating electricity. Embodiments of the invention may be used with combustion turbine 10 or in numerous other operating environments and for various purposes. Combustion turbine 10 includes a compressor 12, at least one combustor 14 (broken away) and a turbine 16.

Compressor 12, combustor 14 and turbine 16 are sometimes referred to collectively as a gas or combustion turbine engine 10. Turbine 16 includes a plurality of rotating blades 18, secured to a rotatable central shaft 20. A plurality of stationary vanes 22 are positioned between blades 18, with vanes 22 being dimensioned and configured to guide air over blades 18. Blades 18 and vanes 22 will typically be made from nickel-based alloys, and may be coated with a thermal barrier coating ("TBC") 26, such as yttria-stabilized zirconia. Similarly, compressor 12 includes a plurality of rotating blades 19 positioned between respective vanes 23.

In use, air is drawn in through compressor 12, where it is compressed and driven towards combustor 14. Combustor 14 mixes the air with fuel and ignites it thereby forming a working gas. This working gas temperature will typically be above about 1300° C. This gas expands through turbine 16, being guided across blades 18 by vanes 22. As the gas passes through turbine 16, it rotates blades 18 and shaft 20, thereby transmitting usable mechanical work through shaft 20. Combustion turbine 10 may also include a cooling system (not shown), dimensioned and configured to supply a coolant, for example, steam or compressed air, to blades 18 and vanes 22.

The environment within which turbine blades 18 and vanes 22 operate is particularly harsh, subject to high operating temperatures and a corrosive atmosphere, which may result in serious deterioration of blades 18 and vanes 22. This is especially likely if TBC 26 should spall or otherwise deteriorate. Embodiments of the invention are advantageous because components may transmit real time or near real time data indicative of a component's condition during operation of combustion turbine 10.

U.S. Pat. No. 6,576,861, the disclosure of which is specifically incorporated herein by reference, discloses a method and apparatus that may be used to deposit embodiments of sensors and connectors for connecting sensors with transmitters or otherwise routing data signals. In this respect, methods and apparatus disclosed therein may be used for the patterning of fine sensor and/or connector features of between about 100 microns and 500 microns without the need of using masks. Multilayer electrical circuits and sensors may be formed by depositing features using conductive materials, resistive materials, dielectric materials, insulative materials and other application specific materials. Alternate methods may be used to deposit multilayer electrical circuits, sensors and connectors such as thermal spraying, vapor deposition, laser sintering and curing deposits of material sprayed at lower temperatures may be used as well as other suitable techniques.

Figure 3:
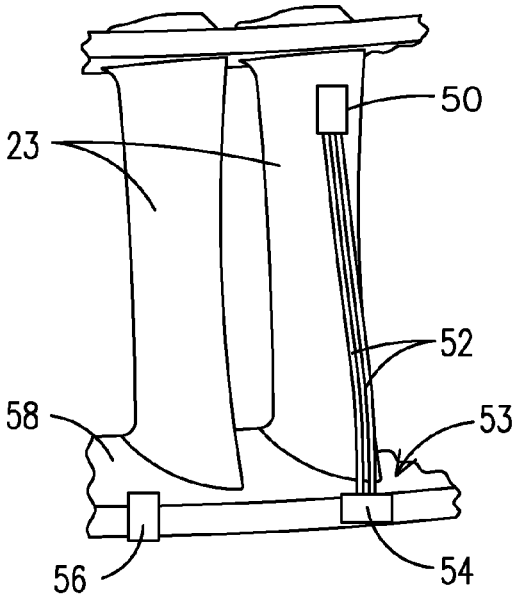
FIG. 3 is a perspective view of an exemplary combustion turbine vane.

FIG. 3 illustrates a pair of adjacent vanes 23 removed from compressor 12 with one blade 23 having a sensor 50 mounted or connected thereto for detecting a condition of the vane. A lead line or connector 52 may be deposited as a means for routing a data signal from sensor 50 to a transceiver 54 configured for wirelessly transmitting the data signal to a receiver 56. Alternatively, the data signal may be wired directly from the stationary vane component out of the engine. Connector 52 may be one or a plurality of electrical leads for conducting a signal from sensor 50 to transmitter 54. Alternate embodiments allow for various types of connectors 52 to be used as a means for routing a data signal from sensor 50 to transmitter 54, depending on the specific application.

Transmitters 54 may be multi-channel and have various specifications depending on their location within a casing of combustion turbine 10. Transmitters 54 may be configured to function within the early stages of compressor 12, which are subject to operating temperatures of between about 80° C. to 120° C. Transmitters 54 may be configured to function within later stages of compressor 12 and/or stages of turbine 16 subject to operating temperatures of greater than about 120° C. and up to about 300° C. Transmitters 54 may be fabricated using silicon-on-insulator (SOI) integrated circuit technology for wireless telemetry transmission circuits and other materials capable of operating in regions with temperatures greater than about 120° C.

Figure 4:
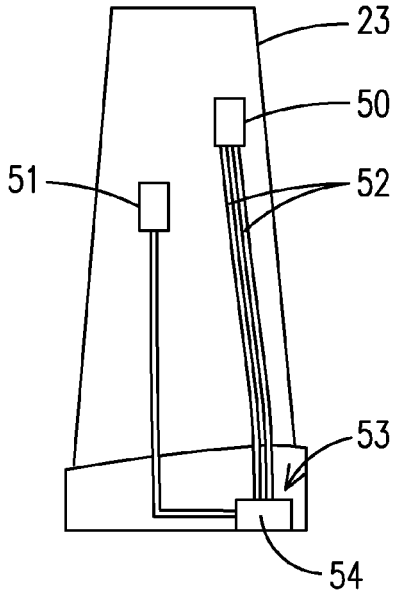
FIG. 4 is a side view of an exemplary combustion turbine blade.

FIG. 4 illustrates a schematic plan view of compressor blade 23 having sensor 50 connected therewith and connector 52 connecting sensor 50 with transmitter 54. A power source 51 may be provided, such as an appropriately sized battery for powering transmitter or transceiver 54. Transceiver 54 may receive signals from sensor 50 via connector 52 that are subsequently wirelessly transmitted to receiver 56. Receiver 56 may be mounted on hub 58 or on a surface external to compressor 12 such as the exemplary locations shown in FIG. 1. Receiver 56 may be mounted in various locations provided it is within sufficient proximity to transmitter 54 to receive a wireless data transmission, such as an RF signal from transmitter 54.

One or more sensors 50 may be connected with one or more compressor blades 23 by fabricating or depositing sensors 50 and connectors 52 directly onto a surface of blade 23. Connector 52 may extend from sensor 50 to a termination location, such as the peripheral edge of blade 23 so that a distal end 53 of connector 52 is exposed for connection to transmitter 54. Sensor 50 and connector 52 may be positioned on blade 23 to minimize any adverse affect on the aerodynamics of blade 23. Embodiments allow for a distal end 53 of connectors 52 to be exposed at a termination location, which may be proximate a peripheral edge of a component or other suitable location. This allows a field technician to quickly and easily connect connector 52 to a transmitter 54 regardless of its location.

Figure 5:
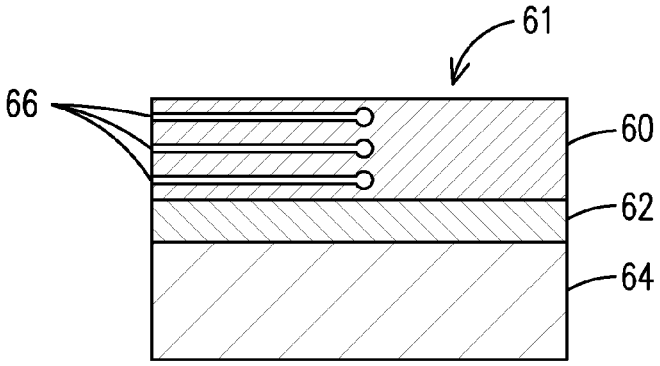
FIG. 5 is an exemplary heat flux sensor deposited on a substrate.

FIG. 5 illustrates an exemplary sensor 61 that may be deposited within a barrier coating such as TBC 60, which may be yttria-stabilized zirconia. TBC 60 may be deposited on a bond coat 62, which may be deposited on a substrate 64. Substrate 64 may be various components such as a superalloy suitable for use in turbine 16 such as a turbine blade 18. Sensor 61 may be formed for various purposes and may include thermocouples 66 deposited using conventional K, N, S, B and R-type thermocouple material, or any combination of their respective constituent elements provided that the combination generates an acceptable thermoelectric voltage for a particular application within combustion turbine 10.

Type K thermocouple materials NiCr or NiAl may be used in sections of compressor 12 having an operating environment up to approximately 800° C. For example, NiCr(20) may be used to deposit a strain gage in compressor 12. Type N thermocouple material, such as alloys of NiCrSi and NiSi, for example, may be used for depositing sensors in sections of turbine 16 having an operating environment between approximately 800° C. to 1150° C.

Type S, B and R thermocouple materials may be used for depositing sensors in sections of turbine 16 having an operating environment between approximately 1150° C. to 1350° C. For example, Pt—Rh, Pt—Rh(10) and Pt—Rh(13) may be deposited to form sensors 50 within turbine 16 provided that the material generates an acceptable thermoelectric voltage for a particular application within combustion turbine 10. Ni alloys, for example, NiCr, NiCrSi, NiSi and other oxidation-resistant Ni-based alloys such as MCrAlX, where M may be Fe, Ni or Co, and X may be Y, Ta, Si, Hf, Ti, and combinations thereof, may be used as sensing materials for high temperature applications in deeper sections of compressor 12 and throughout turbine 16. These alloys may be used as sensing material deposited in various sensing configurations to form sensors such as heat flux sensors, strain sensors, pressure sensors, chemical species sensors, and wear sensors.

Figure 6:
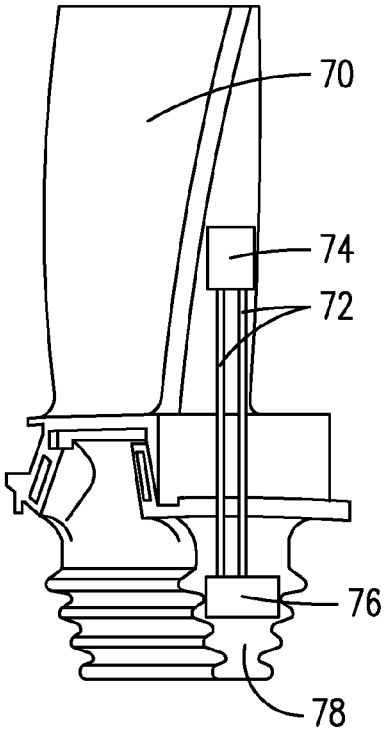
FIG. 6 is a perspective view of an exemplary turbine blade, sensor and wireless telemetry device.

Components within combustion turbine 10, such as blades 18, 19 and/or vanes 22, 23 may have application specific sensors 50 deposited to conform to a component's surface and/or embedded within a barrier or other coating deposited within combustion turbine 10. For example, FIG. 6 shows an exemplary turbine blade 70, which may be a blade from row 1 of turbine 16, having high temperature resistant lead wires, such as connectors 72 deposited to connect an embedded or surface mounted sensor 74 with a wireless telemetry device 76. Device 76 may be mounted in a location where the telemetry components are exposed to relatively lower temperatures, such as proximate the root 78 of blade 70 where the operating temperature is typically about 150° C.-250° C. and higher.

Silicon-based electronic semiconductors, such as those that may be used for transmitting data may have limited applications due to their operational temperature constraints. Temperature and performance properties of silicon and silicon-on-insulator (SOI) electronic chip technologies may limit their applications to operating environments of less than about 129° C. Aspects of the invention allow for such electronic systems to be deployed for wireless telemetry device 76 within compressor 12, which typically has an operating temperature of about 100-150° C.

Embodiments of wireless telemetry sensor systems may be configured to operate within higher temperature regions present in later stages of compressor 12, and within turbine 16. These regions may have operating temperatures of about 150-250° C. and higher. Materials having temperature and electrical properties capable of operation in these higher temperature regions may be used for depositing sensors 50, 74, connectors 52, 72 and fabricating wireless telemetry devices 76.

Sensors 50, 74 and high temperature interconnect lines or connectors 52, 72 may be deposited using known deposition processes such as plasma spraying, EB PVD, CVD, pulsed laser deposition, mini-plasma, direct-write, mini-HVOF or solution plasma spraying. Typically, dynamic pressure measurements, dynamic and static strain, and dynamic acceleration measurements are desired on both stationary and rotating components of combustion turbine 10 together with component surface temperature and heat flux measurements. Thus, embedded or surface mounted sensors 50, 74 may be configured as strain gages, thermocouples, heat-flux sensors, pressure transducers, micro-accelerometers as well as other desired sensors.

Figure 7:
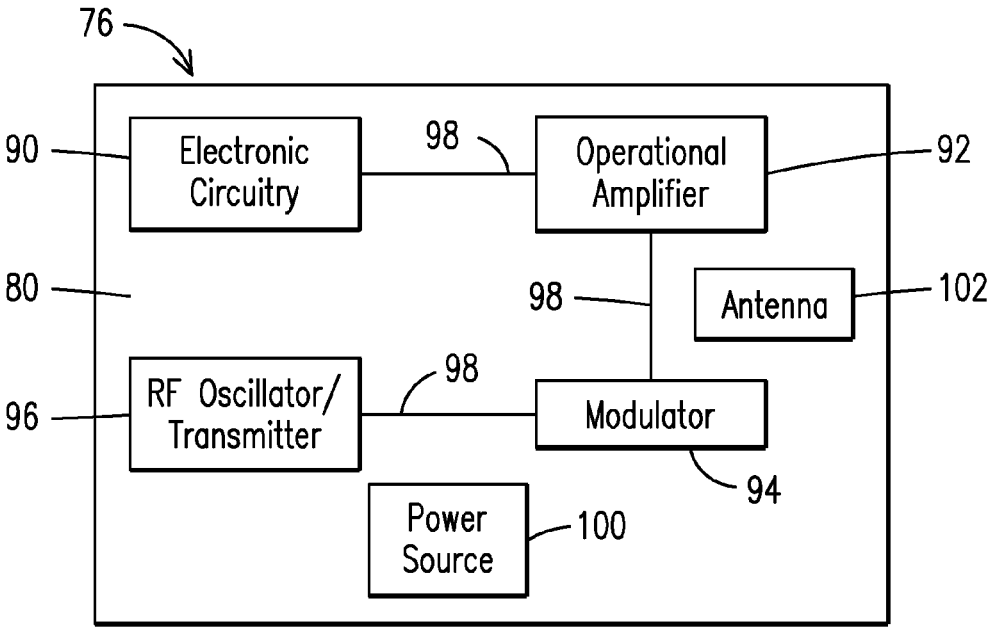
FIG. 7 is a schematic of an exemplar wireless telemetry device.

FIG. 7 is a schematic of a representative embodiment of a wireless telemetry device 76. Device 76 may be formed as a circuit board or integrated chip that includes a plurality of electronic components such as resistors, capacitors, inductors, transistors, transducers, modulators, oscillators, transmitters, amplifiers, and diodes either embossed, surface mounted or otherwise deposited thereon with or without an integral antenna and/or power source. Embodiments of wireless telemetry device 76 may be fabricated for use in compressor 12 and/or turbine 16.

Wireless telemetry device 76 may include a board 80, an electronic circuit 90, an operational amplifier 92, a modulator 94 and an RF oscillator/transmitter 96 electrically connected with each other via interconnects 98. The embodiment of FIG. 6 is an exemplary embodiment and other embodiments of device 76 are contemplated depending on performance specifications and operating environments. Embodiments of device 76 allow for a power source 100, and a transmitting and receiving antenna 102 to be fabricated on board 80 thereby forming a transmitter such as transmitter 54 shown in FIGS. 3 and 4, or wireless telemetry device 76, shown in FIG. 6.

Embodiments of the present invention provide components for use in combustion turbine 10 instrumented with telemetry systems that may include one or more sensors, lead lines connecting sensors with at least one telemetry transmitter circuit, at least one transmitting antenna, a power source and at least one receiving antenna. For example, embodiments of the present invention allow for transmitting sensor data from a rotating component, such as a turbine engine blade having certain electronic components located on a seal plate, which operates in an environment having a temperature of between about 300-500° C. For purposes of the disclosure herein, the term "high temperature" without additional qualification will refer to any operating environment, such as that within portions of combustion turbine 10, having a maximum operating temperature of between about 300-500° C.

Figure 8:
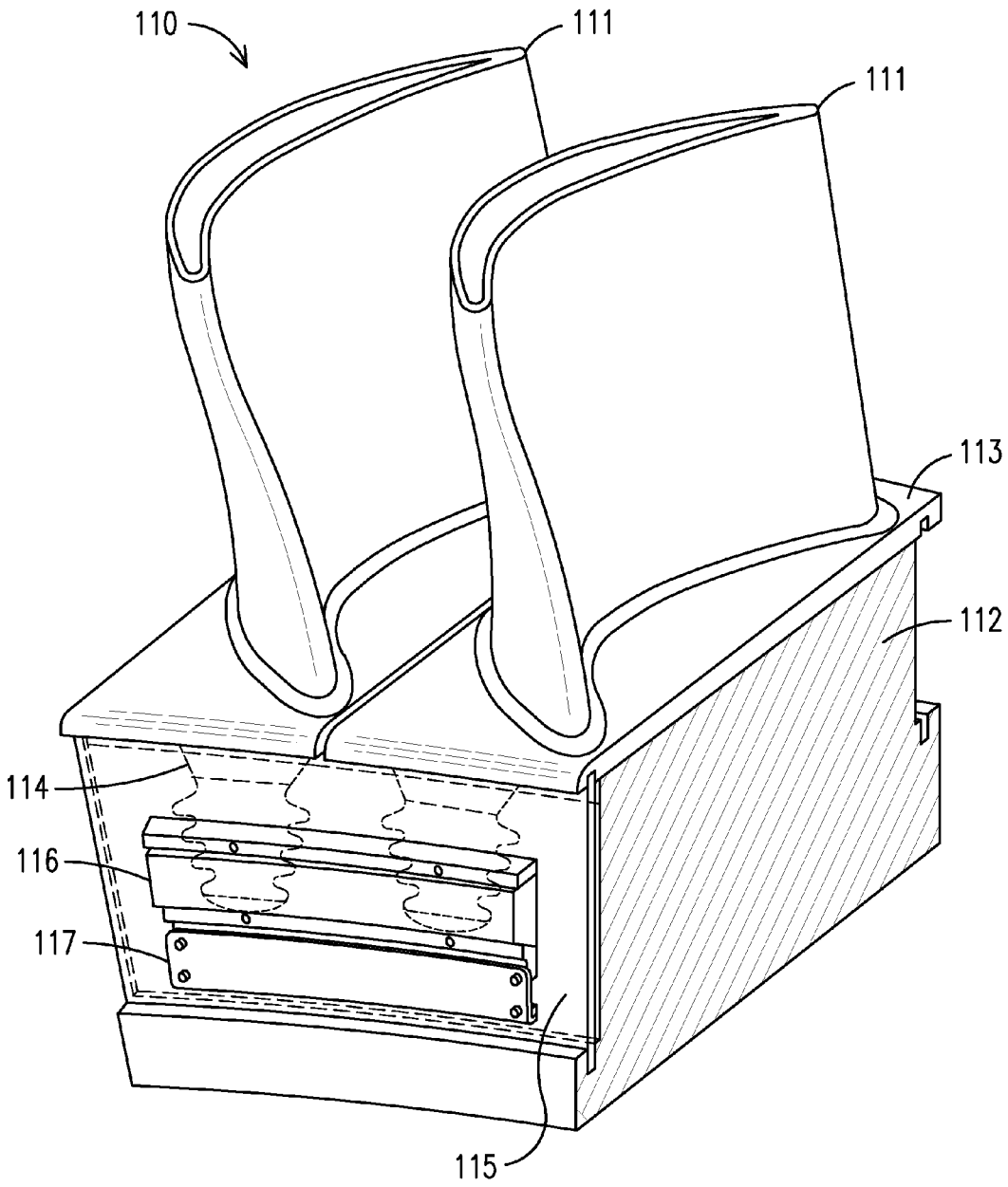
FIG. 8 is a partial perspective view of turbine blades mounted in a rotor disc and seal plate structures mounted to the rotor disc and blade platform and the seal plate structure having telemetry components mounted thereon.
Figure 9:
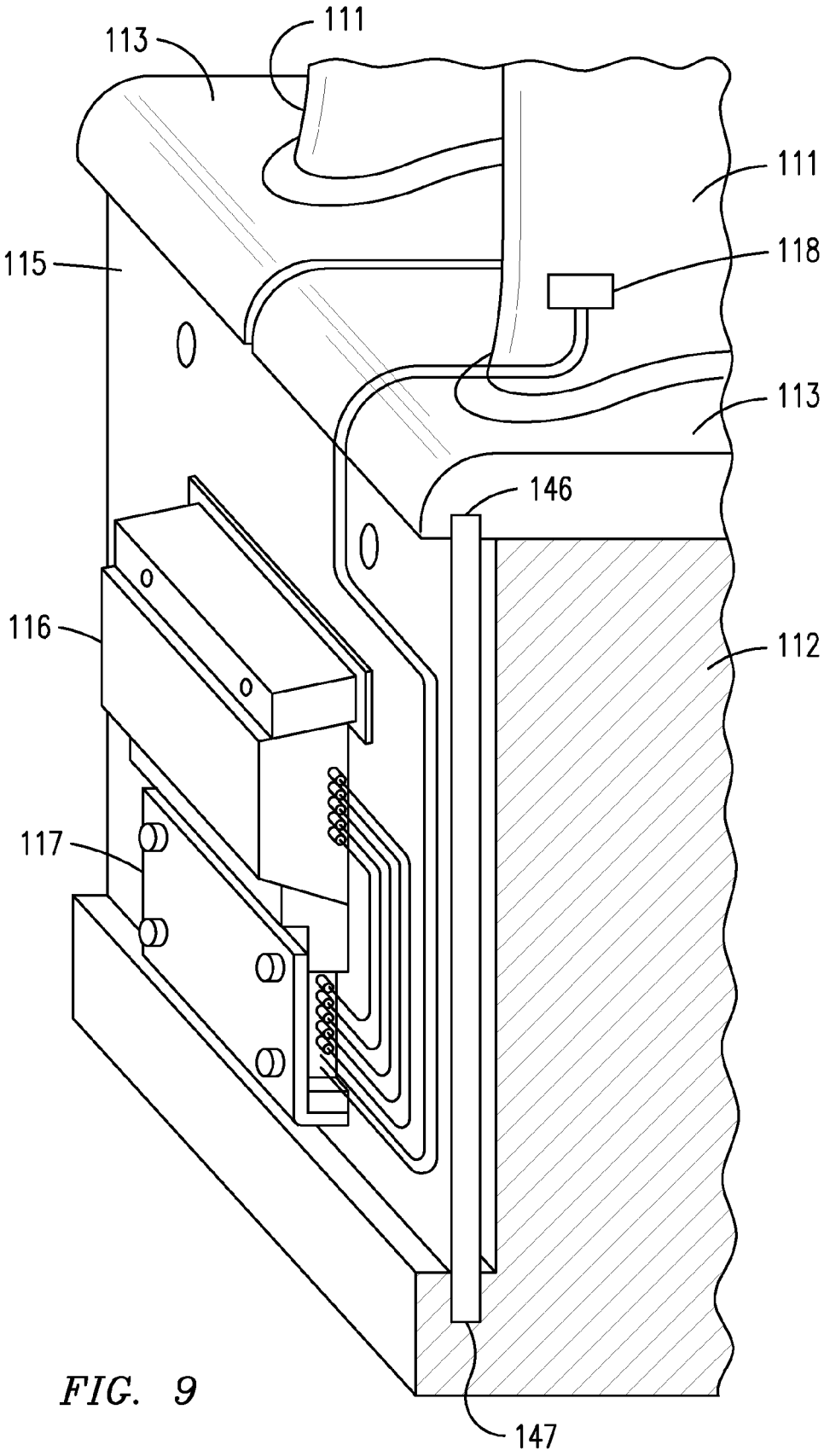
FIG. 9 is a side perspective view of a seal plate structure mounted to the rotor disc and blade platform and the seal plate structure having telemetry components mounted thereon.
Figure 10:
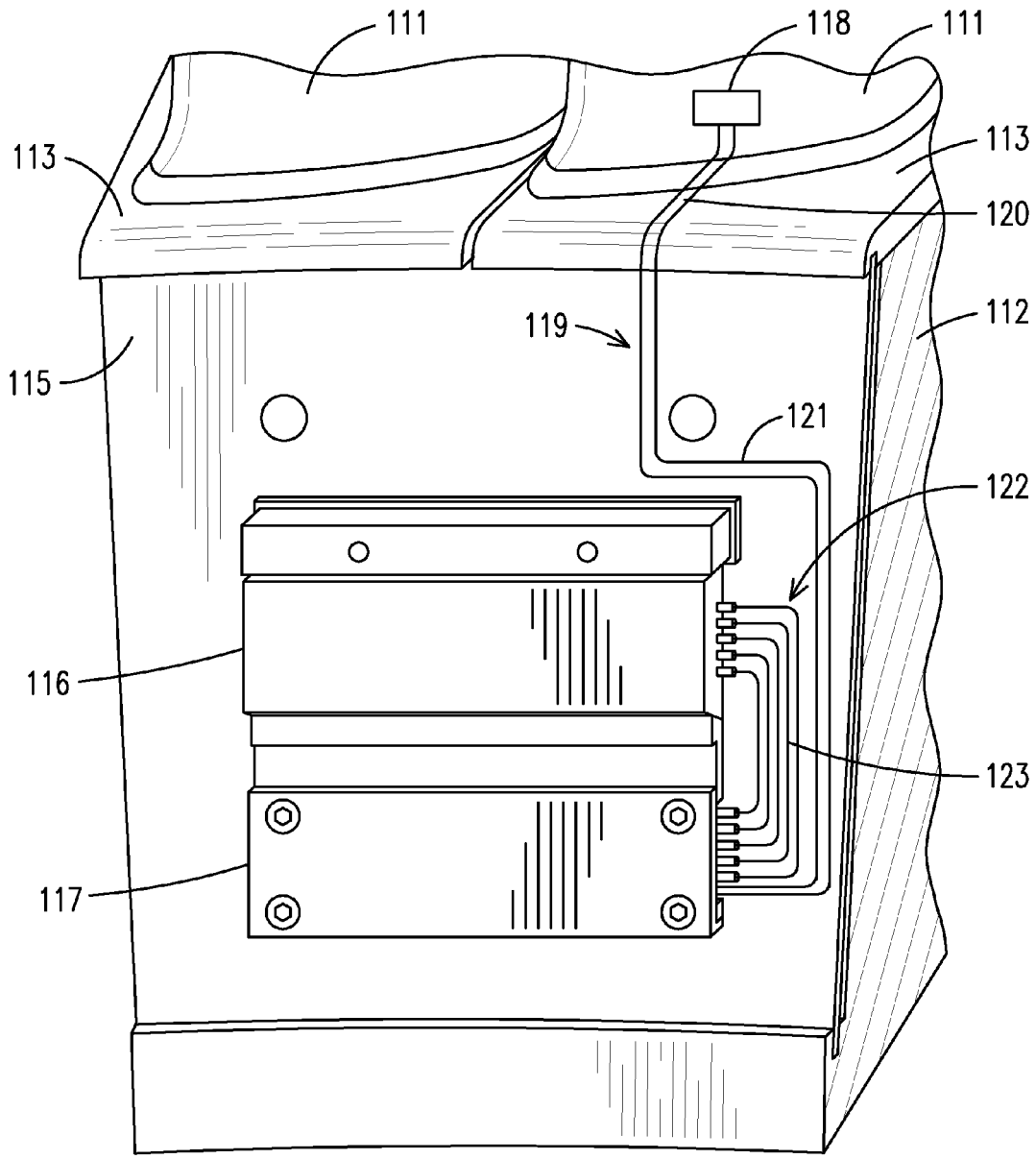
FIG. 10 is an elevational view of the seal plate structure further illustrating an electrical connection of the telemetry components on the seal plate with a sensor on the turbine blade.

With respect to FIGS. 8, 9 and 10, a turbine blade section 110 of a combustion turbine is illustrated including a plurality of turbine blades 111 mounted to a rotor disc 112. As shown, each blade 111 is supported on a platform 113; and, a root 114 is affixed to the bottom of the platform 113 and positioned within root channels (not shown) on the rotor disc 112 for positioning the blades 111 on the rotor disc 112. In addition, a seal plate 115 is shown fitting in grooves 116, 117 in the platform 113 and rotor disc 112, respectively, and covering faces of the blade roots 114. As known to those skilled in the art, a locking mechanism (not shown) may be connected to the seal plate 115 and the rotor disc 112 and/or platforms 113 to secure the seal plate 115 in position. The seal plates 115 inhibit axial movement of the roots 114 relative to the rotor disc 112. In addition, the seal plates 115 seal cooling fluid flow paths that extend to the upstream and/or downstream sides of the blades 111 adjacent lower surfaces of the platforms 113 defining an inner fluid flow path.

In an embodiment of the invention, one or more components of a wireless telemetry system, including the rotating data antenna assembly 116 and/or telemetry transmitter assembly 117, are affixed to the seal plate 115 providing ease of access to such components. With respect to the previously described prior art in which the transmitter assembly is mounted directly to the blade platform, the entire blade must be removed in order to access the transmitter assembly. In the below-described embodiments, the transmitter assembly 117 and other components are mounted to the seal plate 115 and are accessible without removing the blades 111, platforms 113 and roots 114. In addition, if necessary, the seal plates 115 are removable to access the wireless telemetry components.

In reference to FIGS. 9 and 10, there is shown the wireless telemetry system including a sensor 118 disposed on an operating component such as the above-referenced blade 111. As shown, the rotating antenna assembly 116 and telemetry transmitter assembly 117 are mounted on the seal plate 115, which is in turn secured relative to the rotor disc 112 and platform 113. The sensor 118 is in electrical communication with the below-described electronics package of the transmitter assembly 117, which includes a transmitter circuit (also referred to as a transceiver), via a first electrical connection 119. The transceiver received induced power signals and data signals, and transmits data or data signals.

As shown, the first electrical connection may include first lead lines or connectors 120 deposited on the blade 111 in connection with the sensor 118, and on areas of the platform 113. In addition, second lead lines 121 are secured to a surface of the seal plate 115 and connected to the transmitter assembly 117. The transmitter assembly 117 is in electrical communication with the rotating antenna assembly 116 via a second electrical connection 122 that includes electrical lead lines 123 secured to the surface of the seal plate 115. The lead lines 121 and 123 of the first 120 and second 122 electrical connection, respectively, may include electrical wires secured to the seal plate 115 with ceramic cement and/or tack welding techniques.

Embodiments of the invention may include a mounting bracket assembly including a first bracket 125 for affixing the rotating antenna assembly 116 to the seal plate 115 and a second bracket 126 for affixing the telemetry transmitter assembly 117 to the seal plate 115. The brackets 125 and 126 are preferably fabricated or forged from the same metal alloy as the seal plate 115. Accordingly, the seal plate 115 and bracket assembly 124 may be composed of a Ni-based superalloy or any other metal superalloy material that is suitable for components of a combustion turbine.

Figure 17:
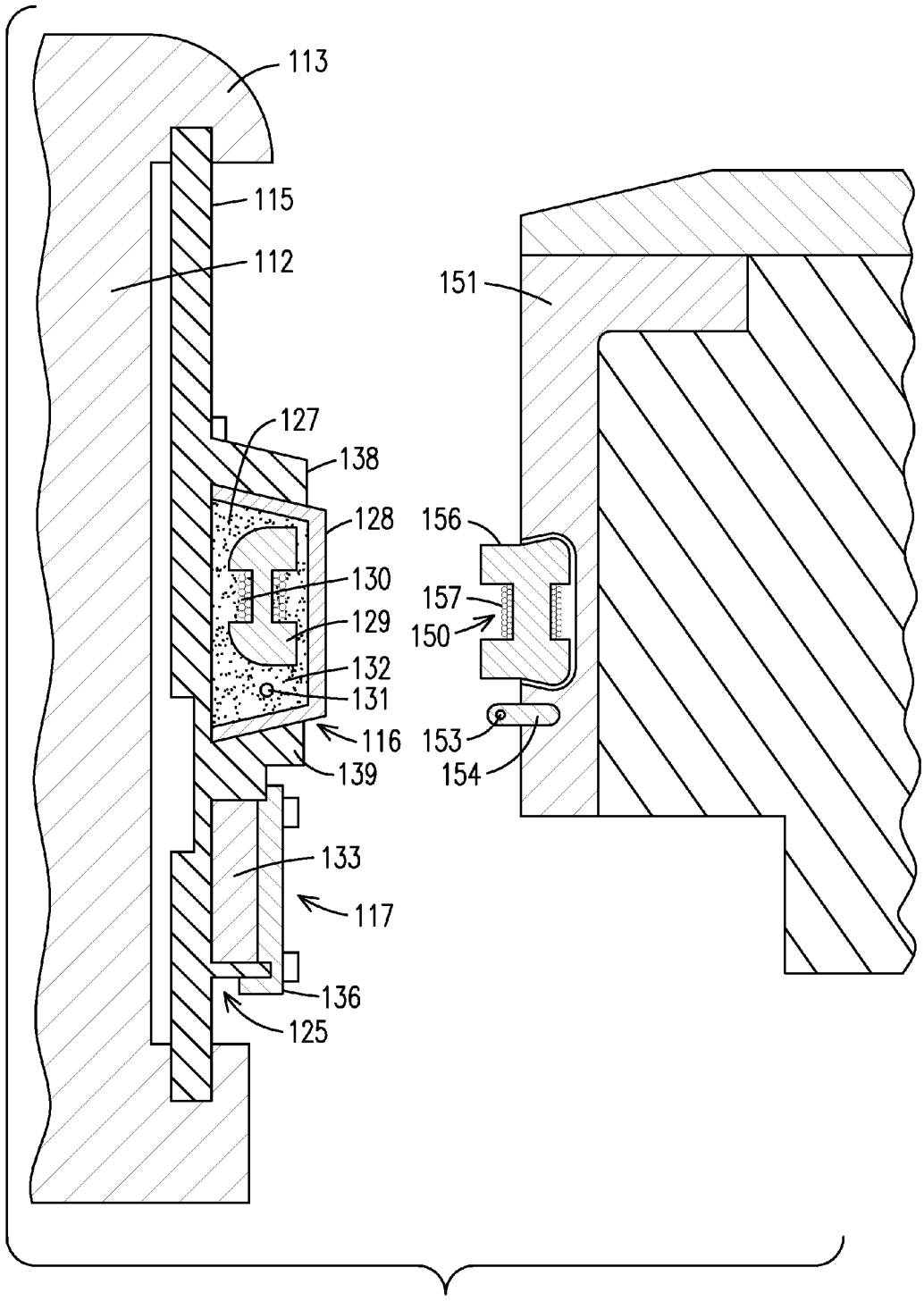
FIG. 17 is a partial cross sectional view of a turbine stationary antenna, mounted to a stationary engine component, and a turbine blade assembly with a seal plate having an exemplary rotating power and antenna assembly mounted thereto.

As shown in more detail in FIG. 17 the rotating data antenna assembly 116 may comprise a rotating secondary induction coil assembly 127 contained within RF transparent cover 128, which is mounted to the seal plate 115 using the first bracket member 124. The rotating induction coil assembly 127 may be fabricated from a core 129 and winding 130. A rotating data transmission antenna 131 is contained in RF transparent cover 128, with a high temperature capable potting material 132 such as a ceramic cement material as known to those skilled in the art. In an alternative embodiment, the core 129, winding 130 and antenna 131 may be secured in the cover 128 by packing these devices and cover with high temperature capable batting, such as can be fabricated from aluminum oxide fiber, or with other high temperate capable fibers. The batting serves to hold the devices in place with minimal weight added to the assembly, and can be pushed into the cover 128 so that the batting biases against the seal plate (or blade root as may be the case for the prior art systems) providing pressure between the cover 128 and first bracket 125. This positive pressure between the cover 128, bracket 125 and seal plate 115 reduces or eliminates impact between the induction coil assembly 127 and antenna 131 that might be caused by engine vibrations, while also allowing for relative motion to occur during heating and cooling that are caused by differences in thermal expansion between the metal mounting bracket 125 and the ceramic cover 128.

The inventors of the present invention have determined that RF transparent cover 128 may be fabricated from an RF transparent, high toughness, structural ceramic materials. Ceramic matrix composites may be used to fabricate housing 128 as well as material selected from a family of materials known as toughened ceramics. Materials such as silicon carbide, silicon nitride, zirconia and alumina are available with increased toughness due to doping with additional elements and/or designed microstructures resulting from specific processing approaches.

One such material that is RF transparent, easy to form, and relatively inexpensive is a material selected from a ceramic family generally referred to as zirconia-toughened alumina (ZTA). Ceramic material selected from this family of aluminum oxide materials is considerably higher in strength and toughness than conventional pure aluminum oxide materials. This results from the stress-induced transformation toughening achieved by incorporating fine zirconium oxide particles uniformly throughout the aluminum oxide. Typical zirconium oxide content is between 10% and 20%. As a result, ZTA offers increased component life and performance relative to conventional pure aluminum oxide materials. Another exemplary material would be zirconia, partially stabilized with 3%-30% additions of oxides, such as magnesia (MSZ) and yttria (YSZ).

The designed microstructures of ZTA and YSZ are fracture-resistant when the ceramic is loaded in compression. However, if loaded sufficiently in tension, the ceramic will fail catastrophically, as with traditional ceramic materials. Consequently, RF transparent cover 128 is designed so that the tensile stresses in the ceramic material are minimized during operation of combustion turbine 10. This is accomplished by designing and fabricating such that (1) all corners, edges and bends of the ceramic components are machined to eliminate sharp corners and edges, in order to reduce the stress concentration factor at these locations, and (2) the orientation and fit of the ceramic component in a rotating antennae mounting bracket 125 is such that during operation the G-forces applied to the ceramic box do not generate significant bending stresses in the attachment flanges. This is accomplished by orienting the flanges parallel with the G-loading direction, rather than perpendicular to the G-loading direction, so the ceramic flange is loaded in compression and not in bending.

Figure 11:
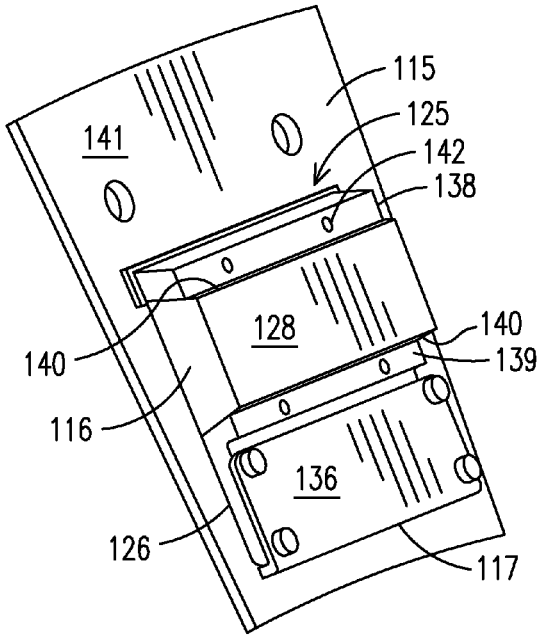
FIG. 11 is a perspective view of a first embodiment of a mounting bracket mechanism for mounting the telemetry components on the seal plate structure.
Figure 12:
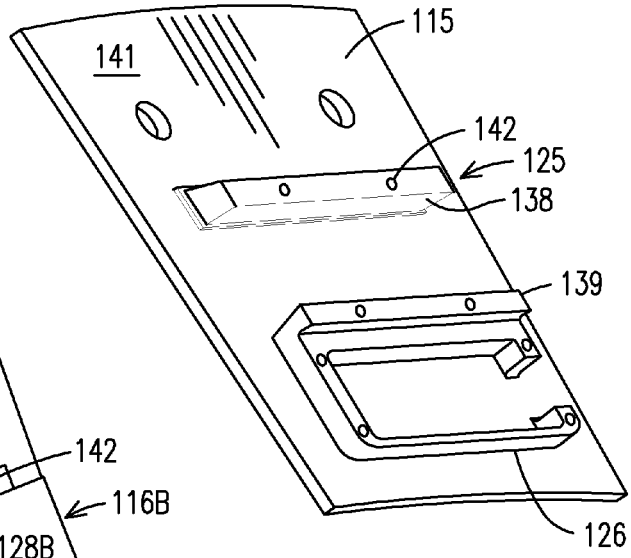
FIG. 12 is a perspective view of the first embodiment of a mounting bracket mechanism for mounting the telemetry components without the telemetry components.

As shown in FIGS. 11 and 12, the first bracket 125 includes two bracket members 138 and 139 spaced apart from one another for receiving the rotating antenna assembly 116. The bracket members 138 and 139 are tilted toward one another and disposed at an acute angle or an obtuse angle relative to a surface 141 of the seal plate 115, depending on the point at which such an angle may be measured. Accordingly, the cover 128 of the antenna assembly 116 has a wedge shaped cross-sectional configuration including sides 140 that are inclined toward one another and are similarly disposed at an acute angle or an obtuse angle relative to the surface 141 of the seal plate 115 depending on the point from which such an angle is measured. The angles at which the sides 140 of the cover 128 are disposed relative to the seal plate 115 are generally equal to the angle at which the brackets 138 and 139 are disposed relative to the surface of the surface 141 of the seal plate 115. As shown, the bracket members 138 and 139 have planar surfaces abutting corresponding surfaces of the cover 128, and apertures 142 for receiving retaining screws to secure the assembly 116 on the seal plate 115.

Figure 1:
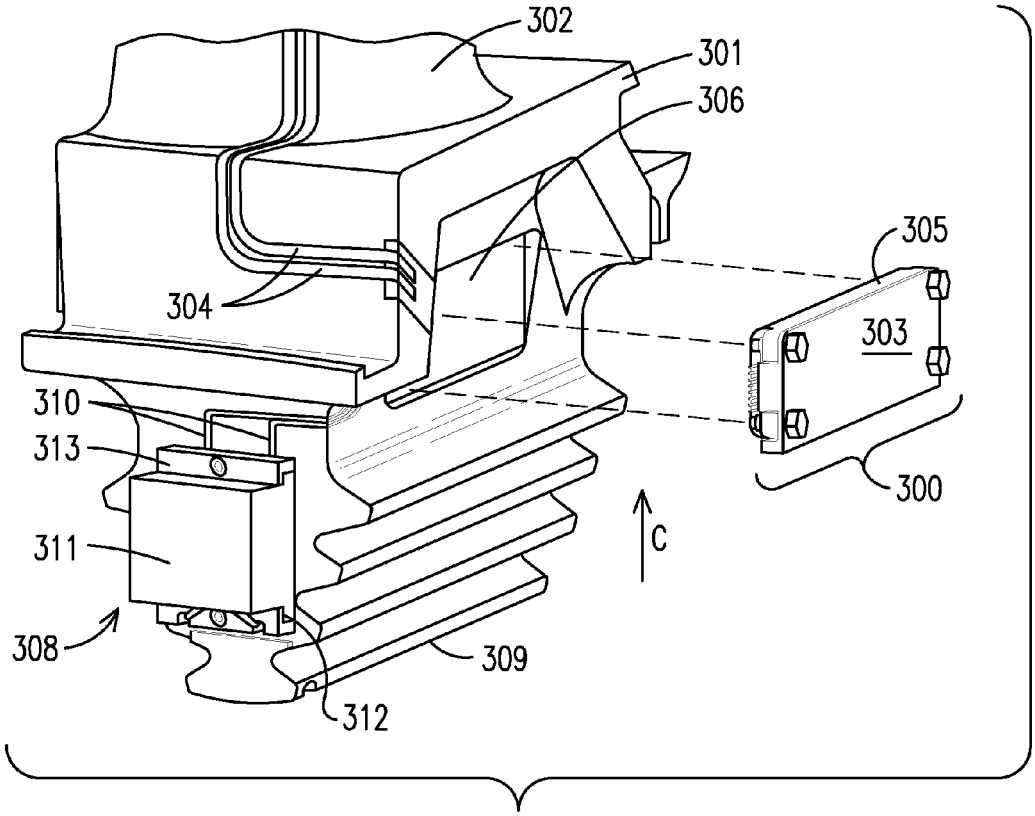
FIG. 1 PRIOR ART
FIG. 1 is a perspective view of a prior art instrumented turbine blade including components mounted thereon for a wireless telemetry system.

Compared to the prior assembly shown in FIG. 1 in which the rotating antenna assembly is mounted to the face of a blade root, the seal plate 115 in the present invention provides a larger surface area for mounting the antenna assembly 116. Accordingly, the antenna assembly 116 is larger and includes a larger antenna and larger induced power transformer coil assembly 127. This translates to more power transmitted to the wireless transmitter circuit/transceiver. In addition, the increased power enables the transmission of signals/data across a wider distance while maintaining the same voltage supplied to the circuit board. The distance/gap between the rotating and stationary antennas (described below) in the wireless telemetry systems will change during operation of the combustion turbine 10, increasing the distance/gap between the stationary and rotating antennas. Thus, the greater the distance/gap signals and data can be transmitted between the antennas creates a greater range of operation of the wireless telemetry system from combustion turbine engine startup to full engine operating temperatures.

Figure 13:
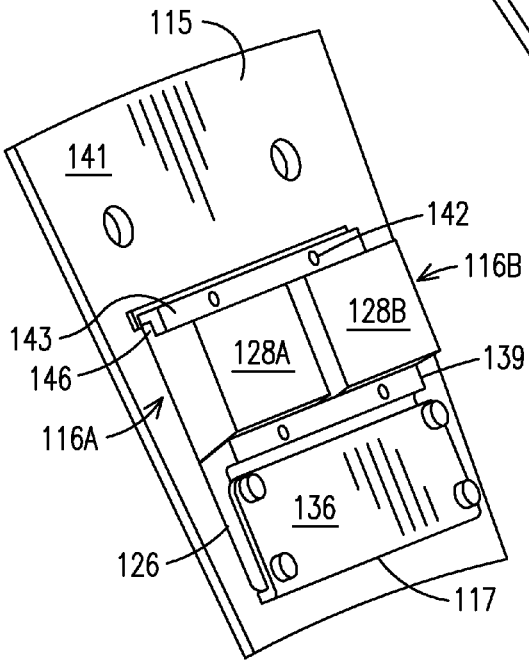
FIG. 13 is a perspective view of a second embodiment of a mounting bracket mechanism for mounting the telemetry components on the seal plate structure.
Figure 14:
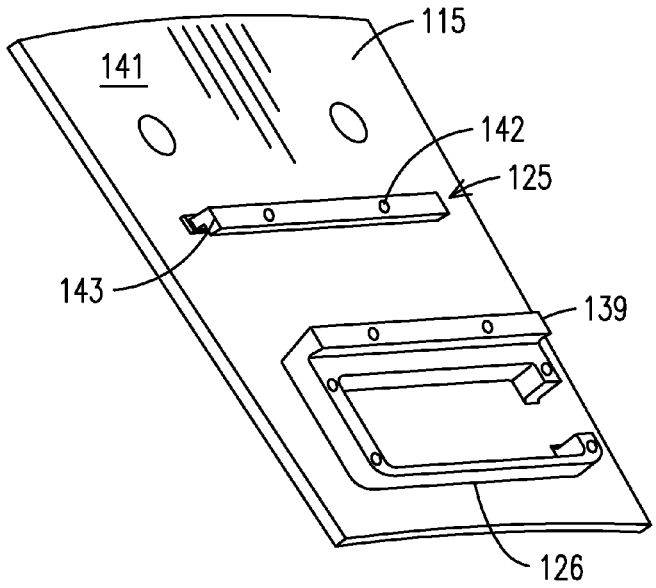
FIG. 14 is a perspective view of the second embodiment of a mounting bracket mechanism for mounting the telemetry components without the telemetry components.

In reference to FIGS. 13 and 14, there is illustrated an embodiment of the invention wherein the first bracket 125 includes the L-shaped bracket member 143 in conjunction with the inclined bracket member 139. As shown, the antenna assembly 116 shown in FIGS. 13 and 14 that is divided into two units including assemblies 116A and 116B and covers 128A and 128B, each having the above-described induced power transformer coil assembly 127 and antenna 131. The assemblies 116A and 116B may include rotating assemblies that are each connected to a corresponding sensor and to the telemetry transmitter assembly 117 so that each antenna assembly 116A and 116B operates independently of the other. Alternatively, an antenna (not shown) may extend from one cover 128A into the other cover 128B, so that both assemblies operate as a single unit connected to a single sensor and the telemetry transmitter assembly 117.

As shown in FIGS. 11-15, a preferred embodiment of the invention includes the second bracket 126 having a pocket type configuration having four walls 126A-126D defining a recess 137 on the seal plate 115 or receiving the telemetry transmitter assembly 117. Thus, the telemetry transmitter assembly 117 may include the second bracket 126 and a lid or cover plate 136 with electronics package 133 positioned therebetween. A plurality of connecting pins 145 extend through the opening 144 and enable connection between an electronic circuit board contained within package 133, such as one having a wireless telemetry circuit fabricated thereon, and various external devices such as lead lines from sensors, induction coil assemblies and/or data transmission antennae. Mounting bracket 126, cover plate 136 and retention screws 118 connecting them together may all be fabricated from the same material as is seal plate 115. This ensures there is no difference in thermal expansion between seal plate 115 and mounting bracket 126. Consequently, no stresses are generated in mounting bracket 126 and/or seal plate 115 during thermal transients.

The electronics package 133 may contain a high temperature circuit board. The main body of electronics package 133 may be fabricated from alloys such as Kovar, an alloy of Fe—Ni—Co. The thermal expansion coefficient of Kovar ranges from about $4.5\text{-}6.5\times10^{-6}/°$ C., depending on exact composition. The Ni-based alloys typically used for high temperature turbine components, such as turbine blade 130 have thermal expansion coefficients in the range of about $15.9\text{-}16.4\times10^{-6}/°$ C. Electronics, package 133 may be affixed securely in place while allowing for relative movement between electronics package 133 and seal plate 115. This relative movement may result from their different thermal expansion rates, which occur over time during the high number of thermal cycles between ambient air temperature and the >450° C. operating temperature typically experienced proximate seal plate 115.

The thermal expansion coefficient of electronics package 133 may be less than that of mounting bracket 126 when the operating system within which these components reside is at a high temperature. Consequently, electronics package 133, including any circuit board contained therein, would expand less than mounting bracket 126, which may lead to damage caused by vibrational energy in the system. In order to secure electronics package 133 within mounting bracket 126 to accommodate the dimensional change differential between bracket 126 and electronics package 133, a layer of ceramic fiber woven fabric 135 may be placed between the electronic package 133 and the inside surface of mounting bracket 126. Fabric 135 may be fabricated from suitable ceramic fiber, including such fibers as silicon carbide, silicon nitride or aluminum oxide. For example, a quantity of Nextel™ aluminum oxide based fabric, manufactured by 3M, may be used for fabric 135. Although, the embodiment of the invention illustrates the use of the fabric 135, this fabric 135 is not required in all instances.

Cover plate 136 may be formed with a flange 146 oriented generally perpendicular to the direction of centrifugal forces (similar to that of the brackets members 138 and 139), to add structural support to the cover plate 136, which counters the centrifugal forces occurring when rotor disc 112 is operating at full speed. This relieves retention screws 118 from carrying the load applied to cover plate 136 via centrifugal forces, and allows them to be made sufficiently small so that the telemetry transmitter assembly 117 fits in a relatively small recess 137 of the bracket member 126 with no interference with any adjacent components. If retention screws 118 were required to carry the load applied by the centrifugal forces, their required size would be too large to fit in the available space.

Embodiments of the present invention may be powered by various means such as induced RF energy and/or by harvesting thermal or vibrational power within the combustion turbine engine 10. In the energy harvested power model, either thermoelectric or vibro-electric power could be generated from the energy available in an operating combustion turbine engine 10. Thermopiles may be used to generate electricity from thermal energy, or piezoelectric materials may generate electricity from vibration of combustion turbine engine 10. Examples of these forms of power sources are described in U.S. Pat. No. 7,368,827, the entire disclosure of which is incorporated herein by reference.

Figure 16:
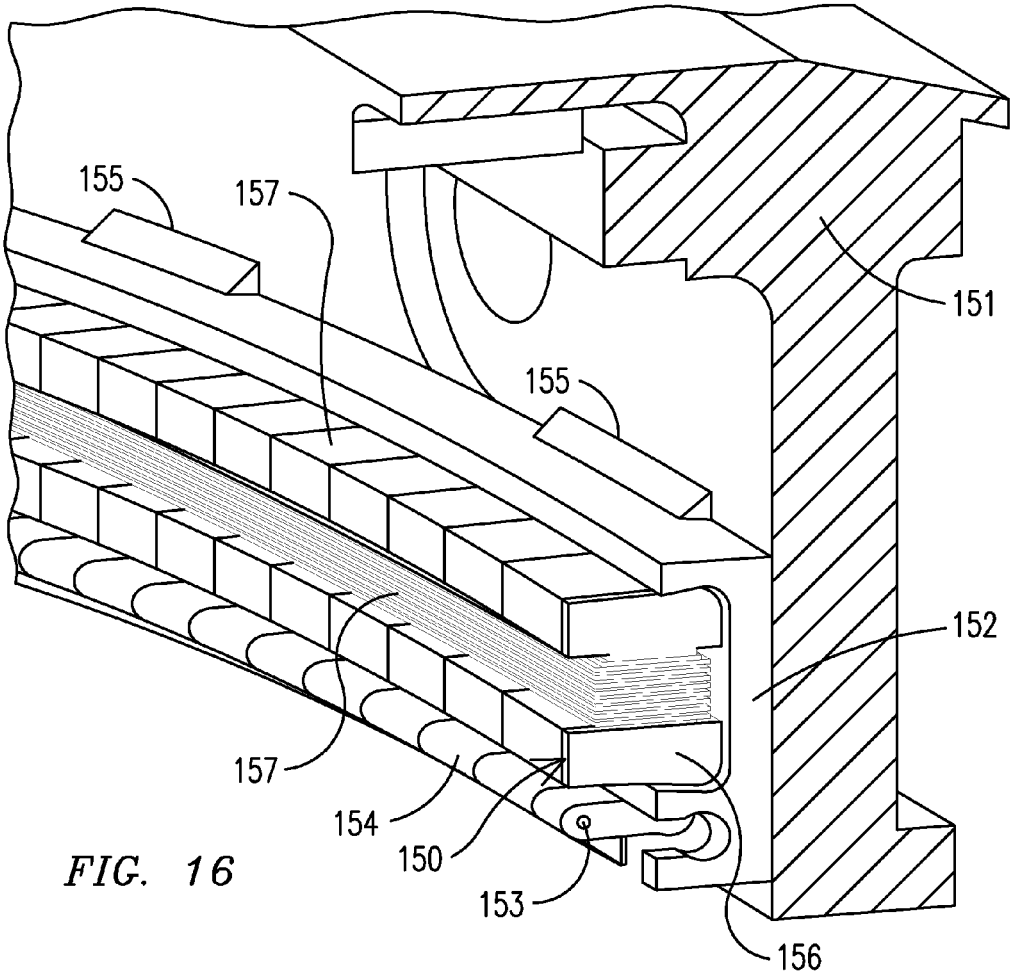
FIG. 16 is a partial perspective view on a turbine static seal having an exemplary embodiment of a stationary antenna assembly mounted thereto.
Figure 19:
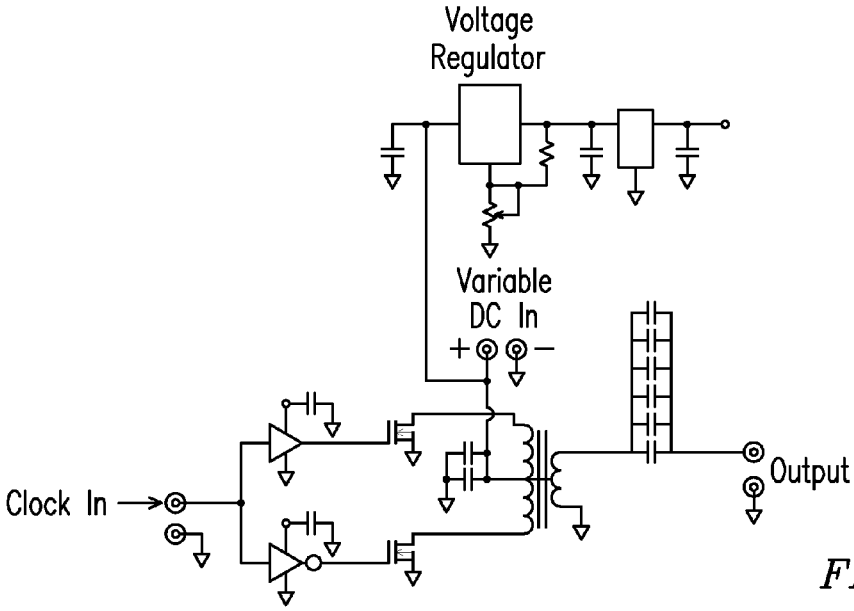
FIG. 19 is a schematic of an exemplary induction power drive circuit.

Induced power modes are provided for powering components of wireless high temperature telemetry systems. Such systems may be configured as air-gap transformers where the transformer primary induction coil assembly 150 is stationary and the secondary induction coil assembly 127 rotates. For example, an induced RF power configuration is provided for powering a rotating telemetry transmitter circuit contained within telemetry transmitter assembly 117. FIG. 16 illustrates a portion of a static seal segment 151 such as one that may be used within the turbine engine 16 of combustion turbine 10. A plurality of static seal segments 151 may encircle turbine engine 10 adjacent to a plurality of turbine blades 111. Static seal segments 151 may cooperate with turbine blades 111 for sealing hot gas within a hot gas path through turbine engine 10 as recognized by those skilled in the art.

FIG. 16 shows an arcuate bracket 152 having respective channels or grooves formed therein within which a stationary data transmission antenna 153 and a stationary primary induction coil assembly 150 may be secured. Data transmission antenna 153 may be inserted into a non-conducting holder 154 for securing data transmission antenna 153 with bracket 152. Non-conducting holder 154 ensures that data transmission antenna 153 does not contact bracket 152, which may be fabricated of electrically conductive metal, thereby ensuring correct operation. Non-conducting holder 154 may be fabricated from the same toughened ZTA or YSZ ceramic material used for the RF transparent cover 128. In the case of employing the antenna 153 in an arcuate bracket 152, such as shown in FIG. 16, holder 154 may be segmented to provide flexibility, which allows for installation in curved bracket 152. The same segmented configuration may be applied to the induction coil assembly 150 to enable installation in the bracket 152.

Primary induction coil assembly 150 and data transmission antenna holder 154 may be formed with lobes in the region of attachment to bracket 152. The associated regions of material in the bracket 152 are removed in the same lobe shape, with slightly larger size to accommodate installation. The lobe shape defines a radius of curvature that enables positive retention of induction coil assembly 150 and antenna and holder 153, 154, which may be placed into bracket 152 from an end and slid into position. The lobe shape enables positive retention to be maintained while simultaneously ensuring that tensile stresses are not generated in induction coil assembly 150 and antenna holder 154, both of which may be fabricated of relatively brittle materials subject to structural failure under tensile stresses.

The lobes may be positioned far enough from the front of induction coil assembly 150 and data transmission antenna 153 to ensure that metal bracket 152 does not interfere with electrical functionality. Ceramic cement may be applied between the surfaces of induction coil assembly 150 and antenna holder 154, and their respective pockets in bracket 152, in order to provide a secure fit and accommodate thermal expansion differences during heat up and cool down. A thin plate (not shown) may be attached on each end of bracket 152 that covers the lobed regions of the induction coil assembly 150 and the data antenna 153, ensuring retention during operation.

One or more brackets 152 may be fabricated of the same alloy as static seal segment 151, such as Inconel 625, and have an arcuate shape to conform to the interior surface of static seal segment 151. Bracket 152 may be affixed to the interior surface of static seal segment 151 using an interrupted weld 155 to minimize distortion of static seal segment 151. Induction coil assembly 150 may include at least one stationary core 156 and at least one stationary primary winding 157 with 'H Cement' 157 sold by JP Technologies, or any ceramic cement that is capable of electrically insulating and structurally protecting the windings, encasing portions of stationary core 156.

FIG. 17 illustrates an embodiment having a rotating secondary induction coil assembly 127 contained within RF transparent cover 128, which may be mounted proximate turbine engine blade root 132. The rotating induction coil assembly 127 may be fabricated from a core 129 and winding 130, similar to the stationary induction coil assembly 150. A rotating data transmission antenna 131 may be provided for communication with stationary data transmission antenna 153. Data transmission antenna 131 may be encased within a non-conducting holder (not shown), which may be similar in construction as non-conducting holder 154. In an alternate embodiment, data transmission antenna 131 may be contained in RF transparent cover 128, without use of non-conducting holder, in which case it may be held in place with a high temperature capable non-conducting potting material. Single or multiple stationary primary induction coils 150 may be arranged on the interior surface of one or more static seal segments 151 to form an arc that is circumscribed by rotating secondary induction coil assembly 127 and antenna 131 when combustion turbine 10 is in operation.

One or more stationary primary winding 157 may be energized by high frequency, high current power sources. The power can be supplied to each stationary induction coil assembly 150 individually, or a series of stationary induction coil assemblies 150 may be electrically connected and driven by a single power supply. In an exemplary embodiment there may be five adjacent, stationary induction coil assemblies 150 with each driven by its own power supply. The current flowing through each stationary primary winding 157 creates a magnetic field in the rotating secondary induction coil assembly 127 that in turn creates a current in the rotating secondary winding 130. The current from rotating secondary winding 130 supplies power to a wireless telemetry transmitter circuit contained within wireless telemetry transmitter assembly 150 as described more fully herein below.

FIG. 17 illustrates that an initial gap "A" may exist between RF transparent cover 128 and stationary core 156 prior to startup of combustion turbine 10. Initial gap "A" may be between about 1 mm to about 100 mm, and typically about 13 mm at startup of combustion turbine 10 and reduce to about 4 mm at baseload when turbine blade 130 and static seal segment 151 are closer together. Another engine configuration may result in an initial gap "A" of about 4 mm at startup of combustion turbine 10 and increase to about 90 mm at baseload when the turbine blade 130 and static seal segment 151 are farther apart. Magnetic core materials may be used to fabricate stationary core 156 and rotating core 129. A magnetic material may be used as a core material in order to couple the required power to a telemetry transmitter circuit contained within telemetry transmitter assembly 150 over the required gap "A." The selected magnetic material acts to focus the magnetic field produced by the stationary primary windings 157 and received by one or more rotating secondary windings 130. This effect increases the coupling efficiency between the stationary and rotating elements.

Embodiments of induced power systems disclosed herein may employ multiple individual primary and secondary induction coil assemblies 150, 127 to accommodate various geometries with combustion turbine 10. For instance, stationary induction coil assembly 150 and data transmission primary antenna 153 may need to span a certain distance of static seal segment 151 in order to induce enough power to the system components and transmit the required data. An embodiment of induction coil assembly 150 and data transmission antenna 153 may need to be approximately four feet in length. In this example, for ease of fabrication, four individual power/antenna assemblies each with a length of approximately one foot may be fabricated with respective brackets 152 and installed adjacent to one another on one or more static seal segments 151. If the end-to-end gap distance between the individual antennae is sufficiently small then the antenna assembly will function as if it were a single, four-foot long antenna. Such antenna assemblies may be formed from straight or curved elements thereby providing assemblies of varying lengths that are straight, curved or otherwise configured as required by the specific application. In an embodiment, a plurality of such antenna assemblies may span an arc of approximately 112 degrees in the top half of one or more static seal segments 151 within turbine 10.

The inventors of the present invention have determined that a particular class of magnetic core materials meets or exceeds the performance requirements of embodiments of the present invention. The general term for this class of materials is a nanocrystalline iron alloy. One composition of this class of material is sold under the trade name NAMGLASS® and has a composition of approximately 82% iron—with the balance being silicon, niobium, boron, copper, carbon, nickel and molybdenum. It has been determined that such nanocrystalline iron alloy material exhibits desirable characteristics such as a Curie temperature greater than 500° C., very low coercivity, low eddy-current loss, high saturation flux density and the permeability is very stable over the entire high temperature operating range.

This nanocrystalline iron alloy material is commercially available in tape-wound configurations in the form of toroids, or "C" core transformer cores. Embodiments of the present invention utilize this nanocrystalline iron alloy material to form an "I" core shape, which was used for the primary stationary core 156. The "I" shape was selected because this shape holds itself in place in the channel on stationary mounting bracket 152. The induction core 156 of each induction coil assembly 150 consists of a plurality of 0.007" thick laminations of nanocrystalline iron alloy material built up into an arc of approximately eleven inches in length. The same nanocrystalline iron alloy material may be used for the rotating antenna 131 transformer core.

The strength of the magnetic field used to couple power between the stationary and rotating elements may be increased by increasing the frequency of the driving signal, i.e., the high frequency AC signal produced by an exemplary induction power driver circuit illustrated in FIG. 16. Thus, embodiments of the present invention may employ a high frequency to drive the stationary primary windings 157, such as frequencies greater than approximately 129 kHz. Alternate embodiments may achieve an operating frequency of at least one Mega-Hertz with a power driver designed to operate at such frequencies. The operating frequencies may range from approximately 150 kHz to approximately 500 kHz.

The wire used for winding cores 156, 129 may be made of about 5% to about 40% nickel-clad copper with ceramic insulation in order to reduce oxidation and failure at high temperatures. The handling characteristics of this wire are significantly more challenging than standard organic-insulated bare copper, as a result of the protective, ceramic coating, and special techniques were developed for the processes of winding both the primary and rotating elements. Other wires may be insulated silver or anodized aluminum.

Two types of ceramic materials may be used in the construction of both the primary and rotating induction coil assemblies 150, 127. It is important to ensure the windings 157, 130 do not short (conduct) to the core elements 156, 129. In addition to ceramic insulation supplied on the wires, a compound, such as H cement, a ceramic cement with ultra fine particle size, may be used as an insulating base coat on the winding cores 156, 129. Once the winding cores 156, 129 are wound they may be potted with Cotronics 940, an aluminum oxide based ceramic cement. In an alternative embodiment, the insulating base coat and potting material may be Cotronics 940 or other ceramic cement material.

Figure 15:
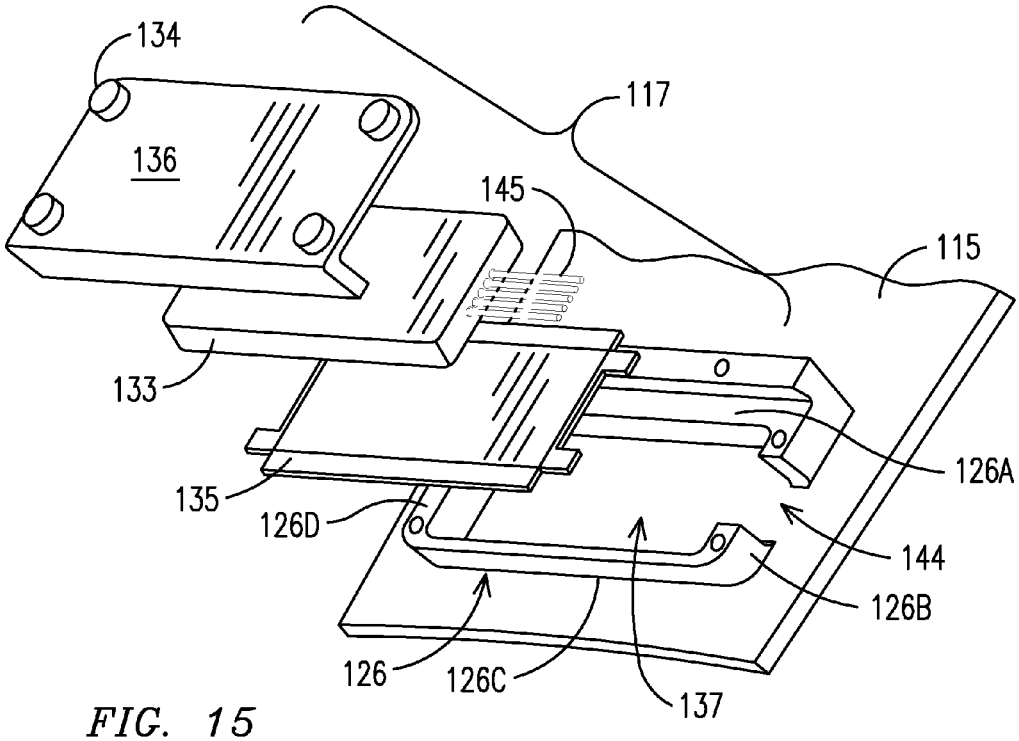
FIG. 15 is an exploded view of a telemetry transmitter assembly and corresponding bracket member.
Figure 18:
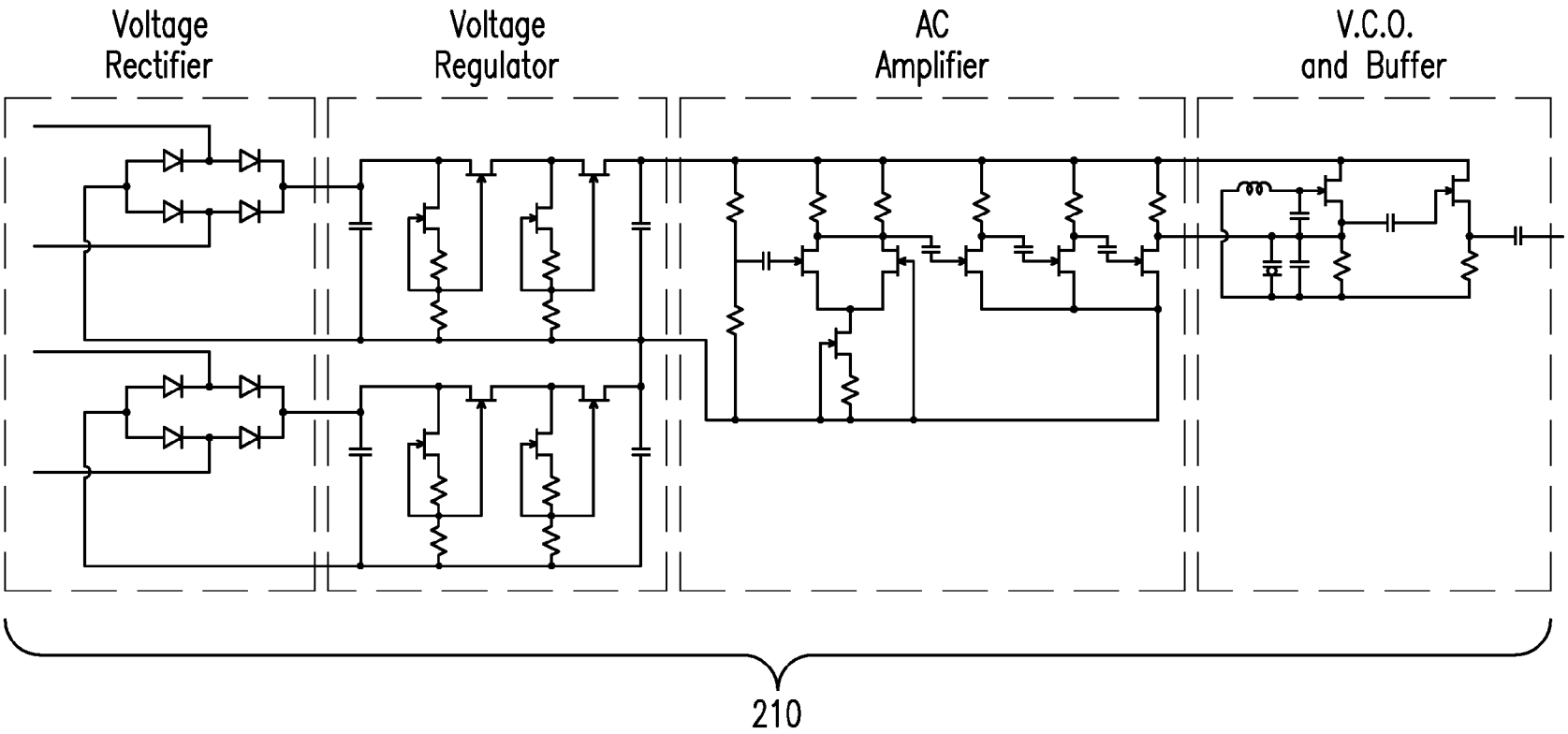
FIG. 18 is a block diagram of an exemplary telemetry transmitter circuit.

FIG. 18 illustrates a schematic of an exemplary telemetry transmitter circuit 210 that may be fabricated on a circuit board fitted inside high temperature electronics package 133 shown in FIGS. 15 and 17, which is contained within telemetry transmitter assembly 117. Telemetry transmitter circuit 210 may be configured for operation with a sensor such as sensor 118 of FIG. 10, which may be a strain gauge sensor for measuring strain associated with turbine blade 130. The rotating secondary induction coil assembly 127 may provide approximately 250 kHz AC power to the voltage rectifier of transmitter circuit 210. This circuit changes the AC input to a DC output and feeds the voltage regulator circuit.

The voltage regulator of transmitter circuit 210 maintains a constant DC voltage output, even though the AC input voltage may vary. A constant voltage output is required to achieve better accuracy and stable operating frequency for the signal output. The voltage regulator also supplies a constant voltage, a strain gauge sensor 118 and a ballast resistor (not shown). The strain gauge sensor 118 and ballast resistor provide the sensor signal input to the transmitter circuit 210. As the surface where the strain gauge sensor 118 is mounted deflects, the strain gauge changes resistance, which causes the voltage at the transmitter circuit 210 input to change.

The varying voltage provided by the signal from the strain gauge sensor 118 is amplified first by a differential amplifier and then by a high gain AC amplifier. The resulting signal is applied to a varactor diode in the voltage controlled oscillator (VCO) section of transmitter circuit 210. The VCO oscillates at a high carrier frequency. This carrier frequency may be set in the band of 125 to 155 MHz with respect to transmitter circuit 210. The fixed carrier frequency is changed slightly by the changing voltage on the varactor. This change in frequency or deviation is directly related to the deflection or strain undergone by strain gauge sensor 118. The VCO carrier output is fed to a buffer stage and the buffer output connects to a transmitting antenna contained in the rotating antenna assembly 142 via lead wires 124 of FIG. 10.

In a receiving device, such as transceiver 56 in FIGS. 2 and 3 or other devices located in high temperature or other areas within combustion turbine 10, the carrier signal is removed and the deviation becomes the amplified output that is proportional to strain. The active circuit devices, such as diodes, transistors, and integrated circuits used in such a transmitter circuit 210 designed for high temperature use may be fabricated from a high temperature capable material, such as wide band gap semiconductor materials including SiC, AlN, GaN, AlGaN, GaAs, GaP, InP, AlGaAs, AlGaP, AlInGaP, and GaAsAlN, or other high temperature capable transistor material may be used up to about 500-600° C.

Various embodiments of wireless telemetry transmitter circuit 210 fabricated on a circuit board may be adapted for use within combustion turbine 10 at varying operating temperatures and with a range of sensor types. Elements of transmitter circuit 210 and alternate embodiments thereof may be fabricated using various temperature sensitive materials such as silicon-on-insulator (SOI) integrated circuits up to approximately 350° C.; polysilseqioxane, PFA, polyimide, Nomex, PBZT, PBO, PBI, and Voltex wound capacitors from approximately 300-350° C.; and PLZT, NPO, $Ta_2O_5$, $BaTiO_3$ multilayer ceramic capacitors from approximately 450-500° C.

Various embodiments of resistors may be fabricated of Ta, TaN, Ti, $SnO_2$, Ni—Cr, Cr—Si and Pd—Ag for operating environments of approximately up to 350° C. and Ru, $RuO_2$, Ru—Ag and $Si_3N_4$ for operating environments of approximately 350° C. and greater. Individual high temperature electronic components, such as discrete transistor, diode or capacitor die made from SiC, AlN, GaN, AlGaN, GaAs, GaP, InP, AlGaAs, AlGaP, AlInGaP, and GaAsAlN, or other high temperature capable semiconducting material, may be replaced by a single SOI CMOS device for operation at temperatures not exceeding approximately 350° C.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

The invention claimed is:

1. A bracket assembly for mounting a wireless telemetry component proximate a rotating component of a combustion turbine engine, the wireless telemetry component including an RF transparent ceramic cover and the bracket assembly comprising:

a first mounting bracket on a surface proximate the rotating component having a first and second bracket member spaced apart from one another disposed generally perpendicular to a direction of centrifugal forces generated by the rotating component and at least one of the first or second bracket members is inclined toward the other bracket and disposed at an acute angle relative to the surface proximate the rotating component;

retention inserts operatively engaging the first and second bracket member and the RF transparent cover to secure the telemetry component to the bracket assembly to the surface proximate the component; and, wherein the RF transparent cover having an inclined side surface abutting a substantially planar surface the at least first or second inclined bracket member.

2. The bracket assembly of claim 1, wherein both the first and second bracket members are inclined toward one another and disposed at acute angles relative to the surface proximate the rotating component and the RF transparent cover has first and second sides respectively abutting planar surfaces of the first and second bracket member and each cover side is disposed at an acute angle relative to the surface.

3. The bracket assembly of claim 1, wherein one of the first or second bracket members has a generally L-shaped configuration that receives a flange portion of the RF transparent and the retention inserts operatively engaging the flange portion.

4. The bracket assembly of claim 1, wherein the first and second bracket members of the first mounting bracket are made of a material having a thermal expansion coefficient that is substantially the same as a thermal expansion coefficient of surface proximate the rotating component.

5. The bracket assembly of claim 4, wherein the rotating component is a turbine blade and the surface proximate the component is a face of a root connected to the turbine blade and disposed in a rotor disc.

6. The bracket assembly of claim 4, wherein the surface proximate the component is on a seal plate connected to a rotor disc and the rotating component.

7. The bracket assembly of claim 1, wherein a rotating data antenna is secured within the RF transparent cover and the bracket assembly further comprising a second mounting bracket for affixing a telemetry transmitter circuit approximate the rotating component.

8. The bracket assembly of claim 7, wherein the rotating data antenna and telemetry transmitter are affixed to a seal plate proximate a turbine blade and the telemetry system includes a sensor on the blade, a first electrical connection for routing data signals indicative of the condition of the blade from the sensor to the transmitter circuit and a second electrical connection for routing data signals indicative of the condition of the blade from the transmitter circuit to the rotating data assembly.

9. The bracket assembly of claim 7, wherein the first mounting bracket and the second mounting bracket are affixed to a seal plate connected to a rotor disc and the rotating component.

10. A bracket assembly for mounting a wireless telemetry component proximate a rotating component of a combustion turbine engine operating at high temperatures up to and exceeding 450° C. and generating gravitational forces up to and exceeding 10,000 Gs, the wireless telemetry component including an RF transparent ceramic cover housing a rotating data antenna and a telemetry transmitter circuit, the bracket assembly comprising:

a first mounting bracket having a first and second bracket member affixed to a surface proximate the rotating component, the first and second bracket member inclined toward another and disposed at an acute angle relative to the surface and having a thermal expansion coefficient that is substantially the same as a thermal expansion coefficient of the surface proximate the rotating component;

wherein the ceramic cover has two side surfaces inclined toward one another and disposed at acute angles relative to the surface and abutting respective planar surfaces of the first and second bracket members;

a second mounting bracket affixed to a surface proximate the rotating component for mounting the transmitter circuit to a surface proximate the rotating component; and, the first and second mounting brackets are each composed of a material having a first thermal expansion coefficient that is substantially the same as a thermal expansion coefficient of the respective surface on which the brackets are affixed.

11. The bracket assembly of claim 10, wherein the rotating component is a turbine blade and the first mounting bracket is disposed on a face of a root of the turbine blade, the root disposed within a rotor disc, and the second mounting bracket is disposed on a platform of the turbine blade, and the telemetry system including a sensor on the turbine blade and first and second electrical connections for routing data signals, indicative of the condition of the turbine blade from the sensor to the transmitter circuit and the rotating antenna.

12. The bracket assembly of claim 10, wherein the rotating component is a turbine blade mounted on a platform and root, the root being disposed in a rotor disc, and the first and second mounting brackets are disposed on a seal plate operatively connected to the platform and the rotor disc, and the telemetry system including a sensor on the turbine blade and first and second electrical connections for routing data signals, indicative of the condition of the turbine blade from the sensor to the transmitter circuit and the rotating antenna.

13. The bracket assembly of claim 12, wherein the second mounting bracket includes a plurality of connected wall members forming a pocket and one of the wall members having an opening therein and the telemetry transmitter circuit is a component of an electronics package having electrical connecting pins connected to the transmitter circuit wherein the electronics package is disposed within the pocket and the electrical connecting pins extending through the opening, and a cover plate is affixed to the wall members covering the electronics package within the pocket, and the cover having a flange oriented perpendicular to a direction of centrifugal forces exerted on the electronics package when the combustion turbine is in operation.

14. The bracket assembly of claim 13, wherein the electronics package has a thermal expansion coefficient different from the first thermal expansion coefficient.

15. A bracket assembly for mounting a wireless telemetry component proximate a turbine blade which is mounted to a platform on a turbine blade root and the root is disposed within a rotor disc, the bracket assembly comprising:

a first mounting bracket having a first and second bracket member affixed to a surface proximate the turbine blade, the first and second bracket member inclined toward another and disposed at an acute angle relative to the surface and having a thermal expansion coefficient that is substantially the same as a thermal expansion coefficient of the surface proximate the rotating component;

wherein the first bracket member is located in an area of the turbine engine which is operating at high temperatures up to and exceeding 450° C. and generating gravitational forces up to and exceeding 10,000 Gss; and, wherein the ceramic cover has two side surfaces inclined toward one another and abutting respective planar surfaces of the first and second bracket members.

16. The bracket assembly of claim 15, wherein the wireless telemetry component includes a rotating data antenna disposed within an RF transparent ceramic cover and the bracket assembly further comprising a second mounting bracket affixing a telemetry transmitter circuit to a surface proximate the turbine blade and proximate the rotating data antenna.

17. The bracket assembly of claim 16, wherein the first and second mounting bracket are mounted to a seal plate that is operatively connected to turbine blade platform and a rotor disc to which the turbine blade and platform are mounted.

* * * * *